US011619421B2

(12) United States Patent
Chu et al.

(10) Patent No.: US 11,619,421 B2
(45) Date of Patent: Apr. 4, 2023

(54) CONTINUOUS-FLOW HEATER, AND A METHOD FOR THE MANUFACTURE OF A CONTINUOUS-FLOW HEATER

(71) Applicant: BorgWarner Ludwigsburg GmbH, Ludwigsburg (DE)

(72) Inventors: Robert Chu, Ningbo (CN); Rob Zheng, Ningbo (CN)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 17/063,377

(22) Filed: Oct. 5, 2020

(65) Prior Publication Data

US 2021/0108826 A1 Apr. 15, 2021

(30) Foreign Application Priority Data

Oct. 10, 2019 (DE) ..... 10 2019 127 364.1

(51) Int. Cl.
*F24H 1/14* (2022.01)
*B22D 19/00* (2006.01)
*F24H 1/10* (2022.01)

(52) U.S. Cl.
CPC ..... *F24H 1/14* (2013.01); *B22D 19/0045* (2013.01); *B22D 19/00* (2013.01); *F24H 1/10* (2013.01); *F24H 1/102* (2013.01)

(58) Field of Classification Search
CPC . F24H 1/10; F24H 1/14; F24H 9/1809; F24H 9/1818; F24H 9/2028; F24H 1/101; F24H 1/102; F24H 2250/08; F24H 1/142; F24H 9/02; B22D 19/00; B22D 19/0045
USPC ..... 392/465; 433/32
See application file for complete search history.

(56) References Cited

U.S. PATENT DOCUMENTS 2,483,056 A * 9/1949 Leckie ..... A47J 37/105 219/544
3,567,434 A * 3/1971 Guha ..... C22C 38/44 420/60
3,709,280 A * 1/1973 MacMillan ..... B22D 19/00 164/112
3,977,459 A * 8/1976 Bonitz ..... B22D 19/0045 164/98
4,344,477 A * 8/1982 Miki ..... B22D 19/0072 164/112
4,381,336 A * 4/1983 Ostwald ..... F16D 65/0006 188/73.31
5,635,305 A * 6/1997 Haga ..... B22D 19/0072 428/596

(Continued)

FOREIGN PATENT DOCUMENTS

DE 11 2016 006 958 T5 2/2019
DE 10 2017 121 341 A1 3/2019
WO WO-2004091832 A1 * 10/2004 ..... B22D 19/00

*Primary Examiner* — Michael G Hoang
*Assistant Examiner* — Andrew W Cheung
(74) *Attorney, Agent, or Firm* — Bose McKinney & Evans LLP

(57) ABSTRACT

A continuous-flow heater is described, with a housing made from an aluminium-based alloy, in which a flow channel for a fluid to be heated extends from an inlet to an outlet, and a heating plate which is arranged in the housing, with a substrate made from steel, which carries heating conductor tracks, a frame embedded in a wall of the housing, wherein the heating plate forms one wall of the flow channel in the housing, and is welded to the frame.

9 Claims, 1 Drawing Sheet

(56) References Cited

U.S. PATENT DOCUMENTS

| | | | | |
|---|---|---|---|---|
| 8,917,981 | B2 * | 12/2014 | Trebouet | B60S 1/487 392/502 |
| 9,028,959 | B2 * | 5/2015 | Iwayama | C22C 1/1036 428/312.6 |
| 9,578,687 | B2 * | 2/2017 | Giffels | H05B 3/24 |
| 10,470,289 | B2 * | 11/2019 | Tsuchida | B22D 19/00 |
| 2003/0141381 | A1 * | 7/2003 | Bissonnette | B60S 1/488 239/132 |
| 2007/0241100 | A1 * | 10/2007 | Stickel | F24H 1/102 134/105 |
| 2008/0099464 | A1 * | 5/2008 | Niederer | F24H 3/0429 219/520 |
| 2010/0199853 | A1 * | 8/2010 | Blanc | H05B 3/50 99/323.3 |
| 2014/0151717 | A1 * | 6/2014 | Otremba | H01L 23/49513 257/676 |
| 2015/0021064 | A1 * | 1/2015 | Wang | H05K 5/0243 164/105 |
| 2015/0090802 | A1 * | 4/2015 | Eckert | F28F 3/12 237/5 |
| 2015/0117847 | A1 * | 4/2015 | Reinholz | F24H 9/1818 392/485 |
| 2016/0360574 | A1 * | 12/2016 | Bohlender | H05B 3/50 |
| 2017/0138633 | A1 * | 5/2017 | Hermida Domínguez | F24H 1/142 |
| 2017/0307001 | A1 * | 10/2017 | Nakashima | B62D 29/008 |
| 2019/0077224 | A1 | 3/2019 | McCarthy et al. | |
| 2019/0135079 | A1 | 5/2019 | Adachi | |

* cited by examiner

CONTINUOUS-FLOW HEATER, AND A METHOD FOR THE MANUFACTURE OF A CONTINUOUS-FLOW HEATER

RELATED APPLICATIONS

This application claims priority to DE 10 2019 127 364.1, filed Oct. 10, 2019, the entire disclosure of which is hereby incorporated herein by reference.

BACKGROUND AND SUMMARY

This disclosure relates to a continuous-flow heater, comprising a housing made from an aluminium-based alloy, in which a flow channel for a fluid to be heated runs from an inlet to an outlet, and a heating plate arranged in the housing, with a substrate made from steel, which carries heating conductor tracks, and forms one wall of the flow channel inside the housing.

With such continuous-flow heaters, sealing must be ensured between the heating plate and the housing. Since the heating plate is exposed to considerable temperature fluctuations, the provision of reliable sealing is a complex process.

This disclosure teaches a means by which such a continuous-flow heater can be manufactured more cost-effectively.

According to this disclosure, the heating plate is welded to a frame embedded in a housing wall, so that a sealing ring or similar can be dispensed with in the provision of sealing between heating plate and housing. A direct materially-bonded joint between the heating plate and the housing wall is difficult and is generally impracticable as the steel substrate of the heating plate cannot be welded to the housing made from an aluminium-based alloy (i.e., an alloy consisting predominantly of aluminium). However, by embedding the frame in a housing wall, a sealed joint can be created between the frame and the housing wall, and the frame can then be welded in turn to the heating plate.

The frame can, for example, be embedded in the housing, in that in the course of manufacture of a housing section, the frame is overmolded with the aluminium-based alloy with which the housing section is manufactured. In other words, the frame can be embedded in the housing, in that it is inserted into a mold that is used to produce a housing section by a casting process, in particular injection molding.

The frame embedded in the housing forms a circumferential or peripheral strip, which protrudes inwards from a wall of the housing section. The heating plate can then be connected to the frame in a leakproof manner, namely by welding. The frame is preferably made from steel, but can also be made from a nickel alloy, or any another material that can be welded to steel.

In an advantageous refinement of this disclosure, provision is made for the frame to be made from a material whose coefficient of thermal expansion lies between the coefficient of thermal expansion of the aluminium-based alloy and the coefficient of thermal expansion of the steel from which the substrate of the heating plate is made. In this way, it is possible to reduce the mechanical stresses that can be generated by differential thermal expansion of housing and substrate, and that can lead to leakage.

Differences in the thermal expansion coefficients stress the joint between the frame and the housing, which when heated can lead to gap formation and thus to leakage from the flow channel. Aluminium-based alloys typically have coefficients of thermal expansion in excess of 20 ppm/K, while steel typically has a coefficient of thermal expansion of 11 to 13 ppm/K. Here the abbreviation ppm stands for parts per million, i.e., 1 ppm=$10^{-6}$.

However, there are also aluminium-based alloys with lower coefficients of thermal expansion, in particular coefficients of expansion of less than 20 ppm/K, such as the alloy A132, which has a coefficient of thermal expansion of 19.0 ppm/K. An aluminium-based alloy with a coefficient of thermal expansion of less than 20 ppm/K is used for the housing in some embodiments of this disclosure.

A stainless steel is preferably used for the frame, in particular a steel with a coefficient of thermal expansion of at least 17 ppm/K. Steels with a coefficient of thermal expansion of at least 19 ppm/K, in particular 20 ppm/K or more, are particularly advantageous. High-alloy steels are preferred, that is to say, steels with at least 5% by weight of an alloying element.

Austenitic steels generally have a higher coefficient of thermal expansion than ferritic steels and are therefore preferred. Nickel steels also have advantageously high coefficients of expansion, for example steels with a nickel content of 5% by weight or more, in particular 10% by weight or more, preferably at least 15% by weight.

The steel grades 302, 304, 305 and 308 each have, for example, a coefficient of expansion of 17.3 ppm/K. Nickel steel with a nickel content of 20% by weight (20Ni) has a thermal expansion coefficient of 19.5 ppm/K. Steel grades containing manganese have particularly high coefficients of expansion, for example the steel NiMn 20 6 has a coefficient of thermal expansion of 20.0 ppm.

In particular, if aluminium-based alloys with higher coefficients of thermal expansion are used, e.g., 220 with a coefficient of thermal expansion of 25 ppm/K, steel grades with very high coefficients of thermal expansion, such as manganese steels MnNi10Cu18 with a coefficient of thermal expansion of 26.0 ppm/K, are also suitable.

In another advantageous refinement of this disclosure, provision is made for the difference between the coefficient of thermal expansion of the aluminium-based alloy of the housing section in which the frame is embedded, and the steel of the frame, to be between 0 and 2 ppm/K, preferably between 0 and 1 ppm/K. Since the frame is surrounded by melt as it is embedded by a casting process, in particular as it is overmolded, the housing section is manufactured in the hot state and then cools down. If during this process the frame contracts more than the housing section, a gap can form, through which fluid can later penetrate. This is avoided if the frame shrinks less than the supporting housing section, i.e., if the material of the frame has a smaller coefficient of expansion than the material of the housing section. However, if the difference between the coefficients of expansion is too large, this leads to stresses in the housing section, which can damage the latter, especially as a result of cracking.

In another advantageous refinement of this disclosure, provision is made for the frame to have apertures for positioning pins. In the course of manufacture of the housing section, positioning pins can engage with the apertures and thus hold the frame in the mold.

The frame preferably forms a ring, for example, a rectangular ring.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
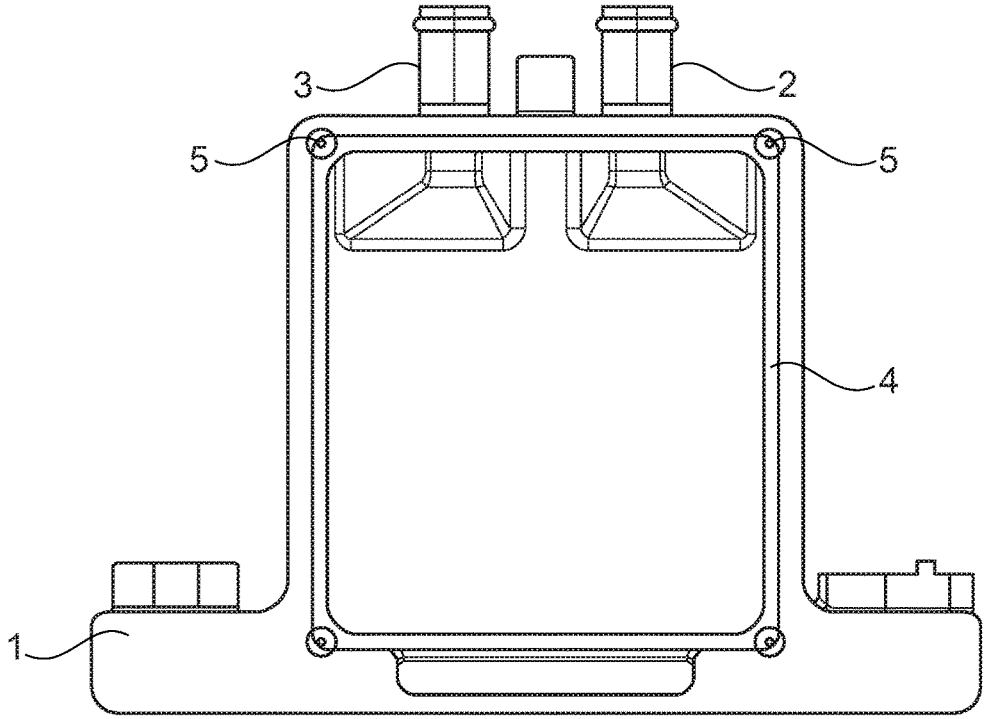
FIG. 1 shows a section of the housing of an inventive continuous-flow heater.

The housing section 1 of a continuous-flow heater shown in FIG. 1 is made from an aluminium-based alloy, and has an inlet 2 and an outlet 3 for the fluid to be heated. A frame 4 is embedded in the housing section 1, which forms an inwardly projecting strip, preferably a peripheral strip. In the example shown, the frame 4 is a rectangular ring, but in the case of a different housing shape can also have a correspondingly different shape.

The frame 4 is embedded in the housing section 1 by an overmolding process. During manufacture, the frame is therefore inserted into a mold, in which the housing section 1 is then formed by a casting process, for example injection molding. The frame 4 can be provided with apertures 5, with which positioning pins engage as the housing section is being cast.

Figure 2:
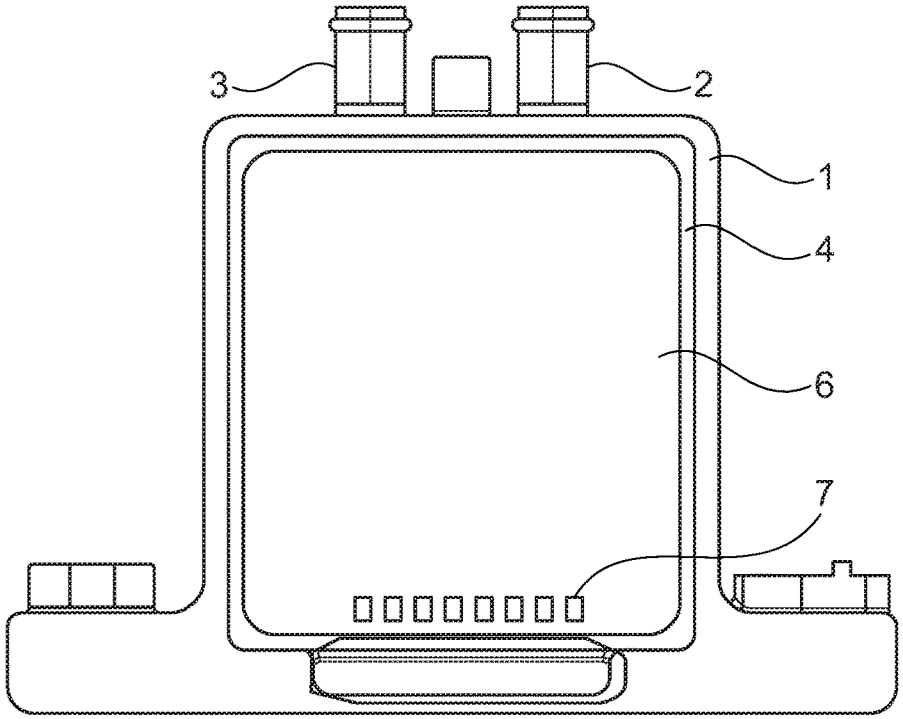
FIG. 2 shows the housing section together with a heating plate.

FIG. 2 shows the housing section 1 of FIG. 1, together with a heating plate 6 positioned on the frame 4, which forms one wall of a flow channel that leads from the inlet 2 to the outlet 3. The heating plate 6 can therefore transfer heat very efficiently to a fluid flowing through the continuous-flow heater. The heating plate 6 has a substrate made from steel, which is covered on its side facing away from the flow channel by an insulating layer, on which heating conductor tracks are arranged. The heating conductor tracks are not shown in FIG. 2. Only contact fields 7 are shown, onto which connecting wires of the heating conductor tracks can be attached, for example welded.

The substrate of the heating plate 6 is welded to the frame 4, so that any sealing elements between the substrate of the heating plate 6 and the frame 4, and between the frame 4 and the housing section 1, can be dispensed with.

A further housing section (not shown) can be positioned on the housing section 1, for example so that heat generated by the heating plate 6 is dissipated to a greater proportion of the fluid in the flow channel, and does not flow away unutilized.

The material of the housing section 1, the frame 4 and the heating plate 6 are matched to each other with respect to their thermal expansion coefficients. Gap formation as a consequence of different thermal expansion coefficients can usually be avoided if the thermal expansion coefficient of the aluminium-based alloy of the housing section 1 is greater than or equal to the thermal expansion coefficient of the material of the frame 4. However, large differences in the thermal expansion coefficients are unfavorable, since severe mechanical stresses can then form as a result of differential thermal expansion, which in extreme cases can lead to damage. For example, it is advantageous if the frame 4 is made from a steel that has a coefficient of thermal expansion that is less than the coefficient of thermal expansion of the aluminium-based alloy, but not less by more than 2 ppm/K.

Steel alloys containing 5% by weight or more of nickel and/or manganese are particularly suitable for the frame 4 and the substrate of the heating plate 6. Steel alloys with a nickel content of 10% by weight or more are even more suitable. For example, the nickel steel NiMn 20 6 (coefficient of expansion 20.0 ppm/K) can be used for the frame 4 and the aluminium-based alloy A13 (coefficient of expansion 20.4 ppm/K) for the housing section 1. The substrate of the heating plate 6 can be made from the same material as the frame 4, or from a steel with a coefficient of expansion which deviates from the coefficient of expansion of the material of the frame 4, for example by 10% or less, preferably by 5% or less.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Housing section
2 Inlet
3 Outlet
4 Frame
5 Apertures
6 Heating plate
7 Contact fields

What is claimed is:

1. A continuous-flow heater, comprising:

a housing made from an aluminium-based alloy;

a flow channel for a fluid to be heated extending in the housing from an inlet to an outlet;

a heating plate arranged in the housing and having a substrate made from steel that carries heating conductor tracks; and a frame embedded in a wall of the housing, wherein the heating plate forms a wall of the flow channel and is welded to the frame;

wherein the frame is formed from a material having a coefficient of thermal expansion between the coefficient of thermal expansion of the aluminium-based alloy of the housing and the coefficient of thermal expansion of the steel of the substrate of the heating plate.

2. The continuous-flow heater according to claim 1, wherein the frame is embedded in the wall of the housing by overmolding.

3. The continuous-flow heater according to claim 1, wherein the frame is made from steel.

4. The continuous-flow heater according to claim 3, wherein the frame is made from a steel having a nickel content of at least 5% by weight.

5. The continuous-flow heater according to claim 1, wherein the frame is made from a material that has a coefficient of thermal expansion of at least 17 ppm/K.

6. The continuous-flow heater according to claim 1, wherein the frame is made from a steel that has a coefficient of thermal expansion that is less than the coefficient of thermal expansion of the aluminium-based alloy by not more than 2 ppm/K.

7. The continuous-flow heater according to claim 1, wherein the frame has apertures for positioning pins.

8. A method for the manufacture of a continuous-flow heater, the method comprising:

inserting a frame into a mold, the frame having a first coefficient of thermal expansion;

casting an aluminium-based alloy in the mold and thereby making the frame embedded in a housing section, the housing section having a second coefficient of thermal expansion different than the first coefficient of thermal expansion; and providing a heating plate having a steel substrate carrying heating conductor tracks and welding the heating plate to the frame, wherein the heating plate has a third coefficient of thermal expansion that is different from the first and second coefficients of thermal expansion, wherein the first coefficient of thermal expansion has a value between the second and third coefficients of thermal expansion.

9. The method according to claim 8, further comprising:

engaging positioning pins in the mold with apertures in the frame during the casting process.

* * * * *